US005838760A

United States Patent [19]

Moses

[11] Patent Number: 5,838,760

[45] Date of Patent: Nov. 17, 1998

[54] METHOD AND APPARATUS FOR PRODUCT X-RADIATION

[75] Inventor: Kenneth G. Moses, 2727 Via Miguel, Palos Verdes Estates, Calif. 90274

[73] Assignee: Kenneth G. Moses, Palos Verdes Estates, Calif.

[21] Appl. No.: 719,803

[22] Filed: Sep. 25, 1996

Related U.S. Application Data

[63] Continuation-in-part of Ser. No. 371,799, Jan. 12, 1995, Pat. No. 5,577,090.

[51] Int. Cl.[6] ..... H01J 35/00

[52] U.S. Cl. ..... 378/119; 378/64; 378/66

[58] Field of Search ..... 378/119, 64

[56] References Cited

U.S. PATENT DOCUMENTS 4,538,291 8/1985 Iwamatsu ..... 378/119

4,553,256 11/1985 Moses ..... 378/119

5,323,442 6/1994 Golovanivsky ..... 378/119

5,577,090 11/1996 Moses ..... 378/119

*Primary Examiner*—Craig E. Church

*Attorney, Agent, or Firm*—Lalos & Keegan

[57] ABSTRACT

An x-ray apparatus and method for irradiating products, e.g. food, includes a hot electron plasma annulus confined by a simple magnetic mirror. The device includes a chamber for confining a gas, heated by microwave energy. The chamber has a central cylindrical opening into which the product is placed or conveyed through to receive x-rays radiating from the chamber. A number of chambers may be arranged coaxially in series to increase product throughput or arranged in an array to irradiate larger products.

27 Claims, 5 Drawing Sheets

METHOD AND APPARATUS FOR PRODUCT X-RADIATION

This application is a continuation-in-part of Ser. No. 08/371,799, filed Jan. 12, 1995. The present invention relates to systems and methods for product irradiation and particularly to x-radiation of foods and water and sterilization of medical wastes.

BACKGROUND

Radiation processing of foods is an effective means of preservation, and of controlling insect infestation, pathogens, spoilage and deterioration. The process eliminates harmful bacteria, such as Salmonella in poultry and E. coli in beef, and insect infestation in grain, fruit and spices. The attributes of enhanced shelf life of disease and insect free food products, afforded by irradiation, promotes wider commercial trade between developing countries and industrialized nations without the dangers associated with the importation of foreign agricultural products. The efficacy of food irradiation processing is well substantiated by the results of research and testing performed over the past forty years throughout the world.

Today, there are twenty-seven countries using irradiation for processing food in commercial ventures in their own domestic market or in developing foreign markets for their food products. The major growth in the commercial use of irradiation for food preservation has occurred in developing countries; however, irradiated fruits, vegetables, spices, and poultry are also accepted in the United States. At the present time, the U.S. Food and Drug Administration (FDA) is under petition to permit the commercial irradiation of hamburger patties. FDA acceptance of the petition is anticipated, and after passage, a very large market for irradiated meat products is expected to develop. In addition to radiation processing of foods, there is a growing need for water and medical waste sterilization systems.

RADIATION SOURCES

Food irradiation facilities use three types of ionizing radiation: 1) Gamma (γ) rays from radioisotopes, 2) X-rays generated by energetic electron bombardment on hard metal targets, and 3) Direct energetic electron impact. This background discussion is limited to γ- and x-ray radiation as their frequency and energy are similar to radiation produced by the device of the present invention. Low energy Gamma rays and x-rays of the same energy differ only in the manner in which the radiation is generated. Both are electromagnetic waves and physically the same. The former is generated by nuclear processes within a radioactive nucleus, while the later arises from acceleration of energetic electrons by electric (Coulomb) forces from atomic targets.

Isotopic Sources of Gamma Radiation

Most current operating irradiation facilities employ large quantities of radioactive cobalt-60 ($_{27}Co^{60}$) as a source of gamma-rays. The energies of the γ-ray emitted by $Co^{60}$ are mainly at 1.332 and 1.173 MeV. Also, the cesium-137 ($_{55}Cs^{137}$) isotope, which emits gamma rays at energies of 0.662 MeV, is used in some food irradiation facilities. Radioactive cobalt is produced artificially in nuclear reactors by bombarding pencil-like rods of stable, naturally-occurring $Co^{59}$ with slow neutrons. The transformation occurs with the absorption of a slow-neutron by a stable $Co^{59}$ nucleus followed by emission of a γ-ray from the unstable product nucleus $Co^{60}$. This form of nuclear reaction is called an n,γ or neutron-gamma ray reaction. The "pencils" of $Co^{59}$ are left in the reactor for one or more years, after which time about 10% of the $Co^{59}$ is transformed into $Co^{60}$. Industrial irradiation facilities require that the radioactive cobalt rods are encapsulated in stainless steel sheaths with welded end enclosures, which in turn are covered with an aluminum sheath with welded end enclosures. Encapsulation of the radioactive material in this manner insures containment of the radioactive materials and prevents contaminating the products undergoing irradiation.

In a typical food irradiation facility, the products are moved automatically into a thick walled, shielded chamber in which a large amount of the encapsulated radioactive isotope $Co^{60}$ or $Cs^{137}$ rods are arrayed on racks to provide proper product irradiation. The total γ radiation dosage received by the food products is determined by exposure time, location of the product within the chamber, and the linear attenuation coefficient $\mu$ of the absorber, which in this case is the food product receiving the radiation. The activity of an isotope source is measured in curies. Typically, a $Co^{60}$ food irradiation facility has isotope source activities of ≈2 to 5 million curies, costing about $1.00 to $1.25 per curie at current prices.

As the emission of γ-rays from radioactive materials cannot be turned off, the isotopes are submerged in a deep pool of water for safe storage when the irradiator is not in use. The contention of opponents of using isotopic radiators for food preservation is the possibility that the metal encapsulation of the radioactive material may fail, contaminating the food or the local environment. The probability of this occurrence is small, and it is further reduced by the stringent monitoring requirements for these facilities that are mandated by law. However, the public's fear of radioactive isotopes still persists.

Electrically Powered X-Ray Sources

Electrically powered x-ray devices cannot contaminate food undergoing processing with radioactive substances, for no radioactive materials are used in the process. Furthermore, x-ray machines can be turned off since they are driven electrically, so they do not have to be stored in deep pools of water when not in use. The ability to turn-off the electrically powered device permits transporting the apparatus without enclosing it in a massive radiation shield as is required for transporting radioactive isotope irradiators. Since transportation is not problematical, an electrical x-ray machine can be brought directly to the crop harvesting area, with a water filled bladder used as a radiation shield. Crop irradiation can be performed in situ. Thus, the "off" property directly reduces capital and operating costs, and also, provides flexibility and mobility in locating the food irradiation facilities. The electrical process of producing x-rays has remained relatively unchanged the since Wilhelm Roentgen at the University of Wurzburg discovered them in 1895 up until the recent invention of the x-ray laser at the Lawrence Livermore National Laboratory. Since, the use of an x-ray laser for food irradiation is not economically feasible, only the classical method of x-ray production, i.e., energetic electron bombardment on a heavy metal target is addressed here.

The impact of energetic electrons produces x-rays through two atomic collision processes: 1) bremsstrahlung radiation is emitted by decelerating energetic electrons during collisions with atoms in the target; and 2) characteristic x-ray emission is radiation emitted by outer bound electrons of the atom upon replacing k or l inner-shell electrons that have been knocked out by incident energetic electrons. Bremsstrahlung emission exhibits a continuous energy spectra up to the energy of the electrons incident on the target, while characteristic radiation appears only at particular or discrete energies (frequencies) determined by the target material. Characteristic x-rays have energies ≈100 keV. The energy of bremsstrahlung x-rays is directly related to the energy of the incident electrons. However, the energy of characteristic x-rays from a given target material is independent of the incident electron energy, provided the incident electron energy exceeds the characteristic x-ray energy. Also, as the electron current incident on the target increases, the intensity of x-ray emission will increase proportionally.

High voltages, produced by electrostatic or inductive generators, accelerate electrons to energies E≈1–5 MeV. After acceleration, the electrons are directed onto a high-Z (atomic number) metal target, e.g., tungsten, to produce bremsstrahlung x-rays. There are several types of electron accelerators, such as Van der Graff, betatrons, sychrotrons, and linacs, that are useful for food irradiation.

Linear accelerators are large, complex, and costly experimental devices, requiring highly skilled personnel to operate and maintain, while providing limited beam access and small irradiation volumes. Thick target bremsstrahlung production by an impacting accelerator beam suffers from the fundamental disadvantage that the beam electrons penetrate only a very shallow depth into solid material. Thus, x-rays appear to be emanating from a point or, at most, a small area source. This circumstance causes the x-ray intensity to fall off inversely with the square of the distance from the point of electron impact, and leads to an uneven distribution of dosage within the volume of the food product being irradiated. If the product is irradiated by a broad parallel beam of x-rays, the x-rays are exponentially attenuated to produce a dose distribution in which the front of the product will receive a higher dose than the back of the product. Thus, a trade-off between exposure time versus irradiated volume ensues. The distribution can be made somewhat more uniform by beam-target curvature tending to converge the x-rays to a focus in back of the product. To increase the x-ray intensity, and thus reduce the stand-off distance for a given volume of food products, one could accelerate more electrons, i.e., increase electron beam current. However, with high current electron beam accelerators come concomitant increases in operating electrical power and cost, target destruction becomes problematical, and accelerator capital cost become unmanageable.

The present invention overcomes the disadvantages of the prior art food irradiation systems. It is an object of the present invention to provide an electrically powered x-ray device that is suitable and practicable for product irradiation generally, and specifically for food irradiation. A further object is to provide steady irradiation at intense radiation levels, a large irradiation volume, and uniform dose distribution. Another object of the present invention is to provide a system that is electrically efficient, reliable, simple to operate and of reasonable cost.

SUMMARY OF THE INVENTION

Ionization is the process in which one or more electrons are detached from an atom, resulting in the formation of a positive ion and one or more free electrons. Plasma, the fourth state of matter, is a heated gas in which a large number of gas atoms are ionized, and the resulting ions and free electrons remain in close proximity to each other. In the device of the present invention, an annular hot-electron plasma is created and confined in a simple magnetic mirror machine by resonant microwave breakdown of the working gas. A simple mirror machine consists of two circular electromagnet coils, centered on a single axis, as depicted in FIG. 1 showing the coil arrangement and magnetic field configuration. Experiments at Oak Ridge National Laboratory (ORNL) and the Plasma Physics Institute at the University of Nagoya over two decades have provided indisputable evidence that an annular hot electron plasma can be maintained, indefinitely, by a continuous wave (cw) source of microwave power. See, for example, the following publications which are incorporated herein by reference:

R. A. Dandl, H. O. Eason, P. H. Edmonds, and A. C. England, "Electron-Cyclotron Heating by 8-mm Microwave Power in the Magnetic Facility ELMO," Relativistic Plasmas, Edited by O. Buneman and W. B. Prardo, W. A. Benjamin, Inc., New York, 1968;

R. A. Dandl, et al, "Electron Cyclotron Heated "Target" Plasma Experiments", Proc. Plasma Phys. and Controlled Thermonuclear Res., Vol.II, Novosibersk, IAEA, August 1968;

M. Hosokawa and H. Ikegami, "Characteristics of Hot Electron Ring in a Simple Mirror Field," Res. Report. IPPJ-497, Nagoya University, 1980;

R. A. Dandl, "Review of Ring Experiments," Proc. of the EBT Ring Physics Workshop, Dec. 3–5, 1979, ORNL-Conf. Proc. #791228, Oak Ridge, Tenn.; and G. R. Haste, "Hot Electron Rings: Diagnostic Review and Summary of Measurements," Proc. of the EBT Ring Physics Workshop, Dec. 3–5, 1979, ORNL-Conf. Proc. #791228, Oak Ridge, Tenn.

The microwave frequency is chosen to be resonant with the second harmonic of the electron cyclotron frequency of particular regions of the mirror field. Heating electrons in this manner primarily increases their perpendicular energy (energy related to the velocity component perpendicular to the magnetic field) at the resonant field position. This perpendicular heating process is referred to as "electron cyclotron heating" (ECH). As electrons gain energy, their collision cross section (probability of colliding with plasma ions and gas atoms) decreases, and the electrons "runaway", i.e., they continually gain energy from the microwave field and accelerate to higher and higher energies. With sufficient microwave power, a very large number of electrons is heated to relativistic energies, and, confined by a magnetic mirror field, they gyrate about field lines while the centers of gyration drift about the magnetic axis of the mirror field. It is these electronic motions that give rise to an annular plasma structure.

In the present invention, the annular plasma is generated in a magnetic mirror preferably having a mirror ratio R=2, i.e., the maximum magnetic field on axis at the center of one field coil is twice the magnitude of the minimum field on axis at the mid plane between the two coils. FIG. 2 shows the drift motion of an electron at the mid-plane of a magnetic mirror field, viewed along the magnetic axis. A large number of energetic electrons, undergoing this cyclonic drift motion in the mirror field, make up a hot electron plasma annulus. The density of energetic electrons in the ECH generated plasma annuli depends on the value of the magnetic field, frequency and power of the microwave radiation, and fill gas density. In the device of the present invention, the required annular plasma density range is preferably about $10^{17}$–$10^{19}$ electrons/m$^3$. The background plasma density ranges from $10^{18}$–$10^{20}$ electrons/m$^3$. Continuous emission of bremsstrahlung results from collisions between the highly energetic electrons in the annulus and the background plasma ions and fill gas atoms. Quantitatively, the power density w radiated by electrons in a plasma due to encounters with only the plasma ions is given by Equation 1:

$$W=4.8\times10^{-37}\ Z^2 n_i n_e T_e^{1/2}\ \text{watts/m}^3$$

where Z is the atomic number of the gas species, $n_e$, $n_i$ is the density of electrons in the annulus and density of background plasma ions, respectively, and $T_e$ is the electron temperature (in keV) in the plasma. See for example, D. J. Rose and M. Clark, Jr., "Plasmas and Controlled Fusion," pg. 233, The MIT Press, and J. Wiley & Sons, Inc., New York, 1961. The use of electron temperature in Equation 1 reveals the tacit assumption of a Maxwellian electron energy distribution in the plasma. Past ELMO experiments, using hydrogen gas, Z=1, at Oak Ridge National Laboratory (ORNL) and the Institute of Plasma Physics (IPP) of the University of Nagoya established the Maxwellian nature of hot electrons in the plasma annulus, as discussed in the above-referenced publications. The bremsstrahlung x-ray spectrum from the ELMO device experiments shows that the electron temperature of the plasma annulus may lie in the MeV energy range. The electron energy distribution plotted in FIG. 3, unfolded from bremsstrahlung data exhibits a high average electron energy and a truncated high energy tail. Truncation of the high energy tail arises from a loss of adiabatic electron confinement at extreme energies. Thus, with an assertion that an electron temperature can be defined for the annular plasma, Equation 1 is used to estimate the radiated bremsstrahlung power from an annular, hot electron plasma confined in a simple mirror field.

Before calculating the radiated bremsstrahlung power from the annulus, an additional bremsstrahlung production process that occurs in the ELMO device is first considered. These x-rays arise from energetic ring electrons impacting the walls of the vacuum chamber in a manner similar to bremsstrahlung production by electron beams from linear accelerators. The velocity vector of some energetic electrons in the plasma annulus is modified by collisions with plasma particles and background gas atoms, i.e., the directed velocities of these electrons are scattered. As a result of these collisions, if the altered velocity vector of a scattered electron is aligned, or nearly so, along the magnetic field lines, the electron cannot experience a magnetic force, nor is it confined by the mirror field. The scattered electron follows the magnetic field lines until it impacts the vacuum chamber wall. Scattered energetic electrons predominately impact the area at the intersection of field lines with the chamber walls, where the sidewalls narrow down to accommodate the mirror field coils. Experimental measurements of radiant power produced at chamber walls agrees well with classical calculations of expected bremsstrahlung power produced by scattered ring electrons striking the walls. See, for example "Hot Electron Rings, etc.", cited above. The impact of these high-energy electrons on the walls results in thick target x-ray emission in the same manner as electron beams striking a tungsten target. In K. Z. Morgan and J. E. Turner, "Health Physics," American Institute of Physics Handbook, 3rd Edition, D. E. Gray, Editor, page 8–305, McGraw-Hill Book Co., New York, 1972 (Reissue 1982), it is reported that bremsstrahlung power $P_B$ radiated from the walls is proportional to the product of the atomic number of the wall material $Z_W$, electron density in the ring $n_e$, background plasma density $n_i$, square root of the electron temperature $T_e$ in the ring, and the volume V of the annulus, i.e., Equation 2:

$$P_B \alpha Z_W n_e n_i T_e^{1/2} V.$$

Thus, the energetic electrons scattered from the rings enhance the rate and intensity of radiation from the device. The proportionality, described by Equation 2, was established by x-ray power experiments on the ELMO Bumpy Torus (EBT), and a series of measurements performed on toroidally-linked magnetic mirror machines. However, the reported radiation levels are only relative measurements and cannot be used for scaling purposes. Therefore, estimates of thick-target x-rays radiation levels are not included in the radiation level calculations for the present invention. Such calculations are based solely on estimates of bremsstrahlung radiation from the annulus electrons and the well documented experimental and operational database of the ELMO studies at ORNL to establish the attractiveness of the present invention for application to radiation preservation of foods or irradiation of products, generally.

In summary, the ELMO experiments at ORNL established the physical basis and understanding of microwave driven, annular hot-electron plasmas in simple mirror machines. From that work, the present invention takes advantage of the following important properties of plasma annuli: continuous stable operation; plasma density scales with microwave power; continuous high-level x-ray emission; radiation level scales with the product of annulus and background plasma density, and hence, microwave power; thick target radiation power from electrons scattered into the chamber walls agrees with classical calculations; operational simplicity; and constructional simplicity.

DETAILED DESCRIPTION

The ELMO experiments form a basis for calculating x-ray flux incident on an imaginary surface lying within a hot electron plasma annulus of the x-ray device of the present invention. However, the present invention departs from the ELMO work by replacing hydrogen (Z=1) as the fill gas with xenon (Z=54) to take advantage of the bremsstrahlung power scaling with $Z^2$ (see Equation 1). Preferably, the present invention utilizes one of the noble gases (xenon, helium, neon, argon) . For computational convenience and simplicity, it is assumed that the hot electrons are distributed uniformly throughout a well defined annular geometry. This calculation, although not rigorous, provides an order of magnitude estimate of the radiant flux levels of the device of the present invention as an x-ray source. The results of this calculation compare favorably to the dosage required for pasteurization and sterilization of various food products. It should be noted that thick target x-rays, produced by scattered ring electrons striking the sidewalls, x-ray emission from electron-atom collisions in the gas, and x-rays penetrating the irradiated food product are excluded from this estimation, making the results of the calculation a very conservative estimate of the radiation levels expected from the device of the present invention.

Figure 1:
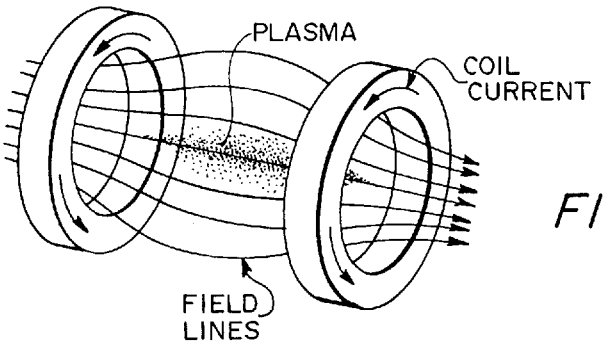
FIG. 1 is an illustration of a simple magnetic mirror machine.
Figure 2:
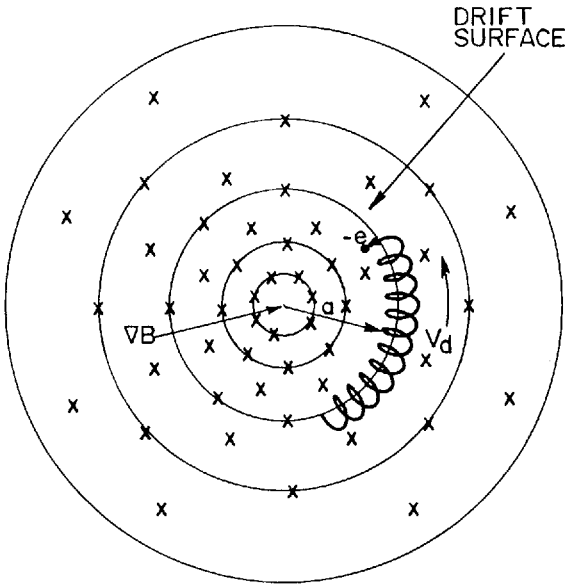
FIG. 2 is a representation of energetic electron drift in a magnetic mirror machine.
Figure 3:
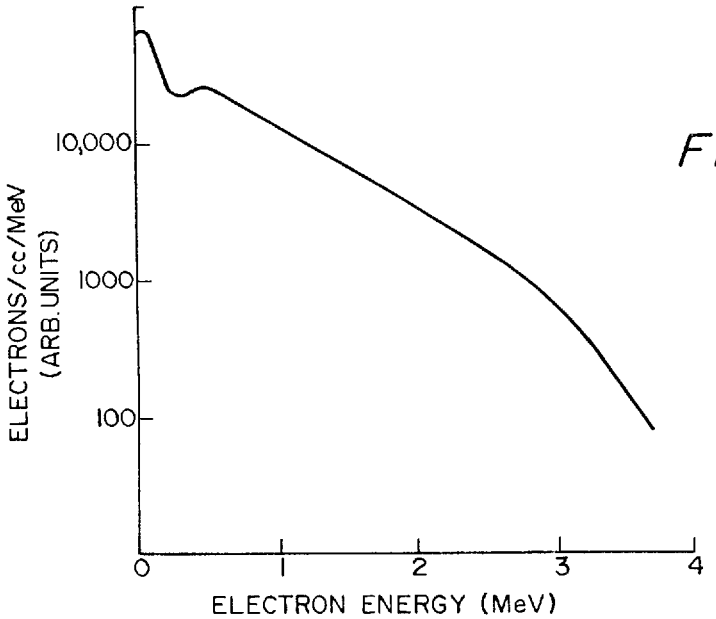
FIG. 3 is an illustration of an unfolded ELMO bremsstrahlung spectrum showing a high energy tail truncation and high average electron energy. (Courtesy of ORNL).
Figure 4:
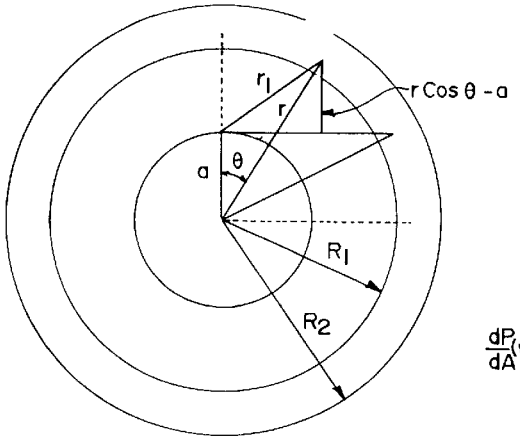
FIG. 4 is an end view of a plasma annulus and irradiated surface.
Figure 5:
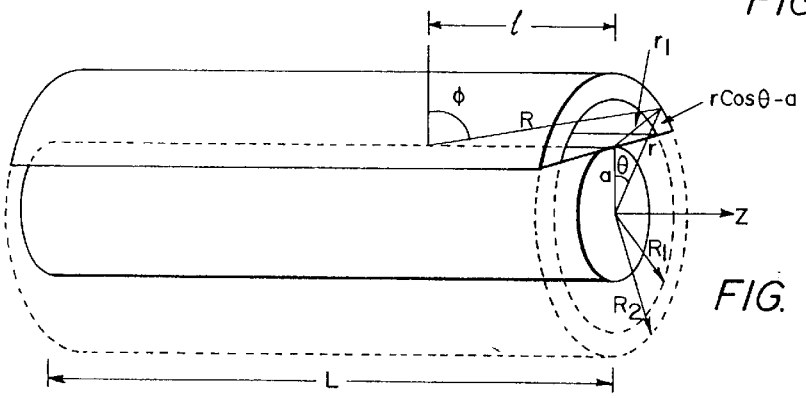
FIG. 5 is a side view of a plasma annulus and irradiated surface.

Referring to FIG. 4, a sharp boundary model is assumed for a hot electron plasma annulus having inner and outer radii $R_1$, $R_2$, respectively. The x-ray power incident per unit area on an imaginary cylindrical surface of radius a (where $a<R_1<R_2$) is calculated. The origin of the cylindrical coordinate system r, θ, z is taken at the right-hand side on the axis of the annulus as shown in FIG. 5. A truncated section of annulus is shown by solid lines in FIG. 5, while the remainder of the annulus is indicated by dotted lines. The truncated section is constructed by tangents drawn at the radius a, perpendicular to the z-axis. The angle of incidence ϕ is defined by an outward normal to the cylindrical surface drawn at the point a,0,−l, and a line of sight from an elementary volume of plasma rdrdθdz within the truncated annulus. Radiation emitted from the truncated plasma volume, passes through the cylindrical surface at a,0,−l with an angle of incidence ϕ lying in a range of $0<\phi<90°$, while radiation from all other plasma regions, $\phi>90°$, pass through the surface from the interior side. The radiation incident from the interior is neglected under the assumption that it is absorbed by material contained within a radius a. Inspection of FIGS. 4 and 5 reveal the following relations:

Equation 3:

$$r_1^2=r^2+a^2-2ar\cos\theta,$$

Equation 4:

$$R^2=(z+l)^2+r_1^2=(z+l)^2+r^2+a^2-2ar\cos\theta,$$

where l is the distance along the z-axis from the edge of the annulus to the irradiated area, and the cosine of the angle of incidence Cosϕ at the point a,0,−l is:

Equation 5:

$$\cos\phi=\frac{r\cos\theta-a}{R}=\frac{r\cos\theta-a}{\sqrt{(z+l)^2+r^2+a^2-2ar\cos\theta}}$$

The limits of integration are also obtained from FIGS. 4 and 5: The angle θ varies over the range, $$0\leqq\theta\leqq\cos^{-1}\frac{a}{R_2}$$

while the radius r varies from $R_1\leqq r\leqq R_2$ and z varies from $0\leqq z\leqq L$. Continuing the calculation of radiant flux emitted as bremsstrahlung from the annulus, the radiant flux or power $dP_S$ radiated by an elementary plasma volume within the annulus is Equation 6:

$$dP_S=wr\,dr\,d\theta\,dz,$$

where the radiated power density w is defined by Equation 1. It is assumed that the radiation is distributed uniformly over a solid angle of 4π steradians. This assumption is not quite correct, for the direction of radiation emitted by energetic electrons will be influenced by the distribution of the energetic electron velocities with respect to the magnetic field and the orientation of the magnetic field within the annulus. These effects tend to increase the x-ray emission in the direction of the axis, i.e., toward the imaginary surfce defined by the radius a, and tend to reduce the x-ray power emitted from adjacent parts of the annulus that would otherwise contribute to the radiant flux through the surface at the point a,0,−l. These effects are expected to offset one another, and for this order of magnitude estimation, they can be neglected without serious loss of accuracy. Under these assumptions, the radiant intensity of the x-rays I, or radiant flux per unit solid angle is calculated as, Equation 7:

$$I=\frac{dP_s}{4\pi}$$

With the elementary plasma volume at the apex, the solid angle dΩ subtended by the surface area dA on the imaginary surface at the point a,0,−l is, Equation 8:

$$d\Omega=\frac{dA\cos\phi}{R^2}$$

and the bremsstrahlung power intercepted by this area is

Equation 9:

$$dP_s=Id\Omega=\frac{IdA\cos\phi}{R^2}$$

Whereby, the irradiance or radiated power per unit area $dP_i/dA$ incident at the reference point from the elementary plasma volume is Equation 10:

$$\frac{dP_1}{dA}=\frac{I\cos\phi}{R^2}=\frac{dP_s}{4\pi}\;\frac{\cos\phi}{R^2}=\frac{w}{4\pi}\;\frac{\cos\phi}{R^2}\;rdrd\theta dz$$

Substituting the expressions for R and Cosϕ and integrating over the radiating source (i.e., the plasma annulus) yields the total bremsstrahlung power per unit area incident at the point a,0,−lradiated by the truncated annulus, is Equation 11:

$$\frac{dP_1}{dA}=2\int_0^L\int_0^{\theta_1}\int_{R_1}^{R_2}\frac{w}{4\pi}\;\frac{r\cos\theta-a}{[(z+l)^2+r^2+a^2-2ar\cos\theta]^{1/2}}\;rdrd\theta dz,$$

where $$\theta_1 = \mathrm{Cos}^{-1}\frac{a}{R_2}\ .$$

The factor of 2 in front of the integral is due to symmetry in the integration over θ as it is performed only from $\theta_1$ to 0.

As a quantitative example, consider a hot electron plasma annulus in the device of the present invention with dimensions $R_1$=0.5 m, $R_2$=0.6 m, and l=1 m. We take an imaginary cylindrical surface with a radius a=0.2 m, coaxial with the annulus, and calculate the incident power per unit area, i.e., the x-ray irradiance, incident on this surface for a background plasma density $n_i=5\times10^{18}m^{-3}$, with ring electron density $n_e$=0.1 $n_i$, and an electron temperature $T_e$=2 MeV in the rings. The results of integrating Equation 11 in watts per square meter incident at the cylindrical surface is plotted as a function of position l along the axis in FIG. 6. As expected, the irradiance is distributed symmetrically about the middle of the cylindrical axis. The x-ray irradiance ranges from about 2.4 kw/$m^2$ at the ends of the 0.2 m radius cylindrical surface to greater than 4 kw/$m^2$ at the center.

To compare dose rates obtainable from the x-ray device of the present invention with dose rates available from conventional food irradiation facilities, the calculated irradiance values must be converted to exposure rates, i.e., from watts/$m^2$ to Rad/s. The American Institute of Physics Handbook gives the exposure-to-fluence conversion in air as Equation 12:

$$1\ \text{roentgen} = \frac{2.15\times10^9}{E}\ \frac{\text{Photons}}{\text{cm}^2}$$

where the photon energy E is in MeV. Assuming that the average energy of x-ray photon emission from the plasma is equal to the average energy of the electrons in the annulus, i.e., the electron temperature $T_e$=2 MeV, then, the average number of photons/s for an incident radiant flux of 1 w/$m^2$ is Equation 13:

$$1\frac{w}{\text{m}^2} = 10^{-4}\frac{J}{s-\text{cm}^2} = \frac{10^{-4}}{1.6\times10^{-13}T_e}\ \frac{\text{Photons}}{s-\text{cm}^2}$$

where, $T_e$ is in MeV. Dividing Equation 13 by Equation 12 and cancelling out the photon energy gives a conversion factor of Equation 14:

$$1\frac{w}{\text{m}^2} = 0.291\frac{\text{roentgen}}{s}\ \text{or},\ 1\frac{\kappa w}{\text{m}^2} = 291\frac{\text{roentgen}}{s}$$

Figure 6:
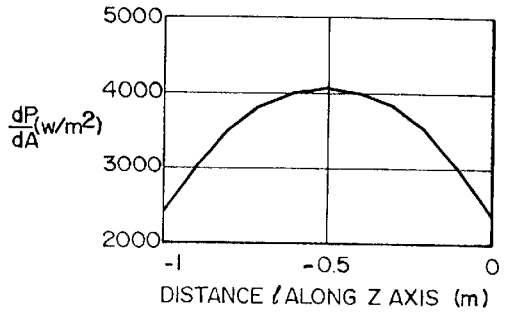
FIG. 6 is a plot of the incident bremsstrahlung power per unit area (w/m$^2$) striking an imaginary surface as a function of position along the axis for background plasma density $n_i=5\times10^{18}\text{cm}^{-3}$ and electron ring density $n_{er}=0.1n_i$.

Now, referring to the plot in FIG. 6, an object placed in the radiation field within an imaginary surface of radius a=0.2 m will be subjected to a dose rate of about 700 roentgen/s at the ends of the axis to about 1,170 roentgen/s at the middle of the axis of the device of the present invention.

Conversion from exposure in roentgens to absorbed dose in Rads for an equivalent energy fluence on the medium, is obtained through the use of the following relation as discussed in T. N. Padikal, "Medical Physics," A Physicist's Desk Reference; Second Edition of Physics Vade Mecum, H. L. Anderson, editor in chief, page 227, American Institute of Physics, 1989.

Equation 15:

$$D_{H_2O} = \left(0.869\frac{(\mu_{en}/\rho)_{H_2O}}{(\mu_{en}/\rho)_{air}}\right)\times(\text{Rad})$$

where X is the exposure in roentgens, $D_{H20}$ is the dose absorbed in Rads by a medium which has a mass energy absorption coefficient $(\mu_{en}/\rho)_{H20}$ equivalent to that of water. The values of the absorption coefficient $(\mu_{en}/\rho)$ for air and water are $2.342\times10^{-3}$ and $2.604\times10^{-3}m^2/kg$, respectively, for a mean photon energy of 2 MeV. Evaluating the term in the brackets results in a factor of 0.966 multiplying the exposure X in roentgens to obtain the dose in Rads absorbed by a water-like material. The overall conversion factor from w/$m^2$ to Rads/s is 0.281 Rads/s/w/$m^2$. Continuous dose rates of 668 Rad/s at the ends and 1,139 Rad/s at the middle of the axis of the x-ray device of the present invention are obtained as a result of the calculation.

The total bremsstrahlung power radiated by the annulus in the device of the present invention is obtained by evaluating the power density w for the chosen parameters and forming its product with the volume of the annulus. Using the parameters specified above and Equation 1, the total bremsstrahlung power radiated by the annulus is 54 kw for background plasma density of $5\times10^{18}m^{-3}$.

Figure 7:
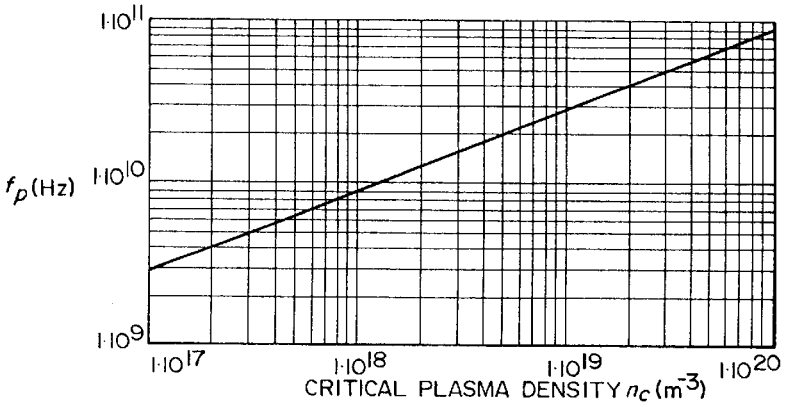
FIG. 7 is a plot of plasma frequency as a function of critical plasma density.

The range of usable background plasma densities in the x-ray device of the present invention is determined by the plasma frequency $f_p$, i.e., the cutoff frequency for electromagnetic propagation through a plasma. The plasma frequency $f_p$ is given by, Equation 16:

$$f_p = \frac{1}{2\pi}\left(\frac{n_c e^2}{m_e\epsilon_e}\right)^{1/2} \approx 9\sqrt{n_c}$$

where $n_c$ is the critical density for cutoff of electromagnetic wave propagation through the plasma, e is the electronic charge, $m_e$ is the electron mass, and $\epsilon_o$ is the permittivity of free-space. If the background plasma density exceeds the critical density value, microwave power cannot penetrate to the resonant region of the mirror field, so that ECH and hot electron production ceases. The relation between cutoff plasma frequency as a function of density, Equation 16 is plotted in FIG. 7. Referring to FIG. 7, high power tubes, generating microwave frequencies of 9 GHz to 90 GHZ, are required to operate an x-ray device of the present invention with background plasma densities over a range from $10^{18}$ to $10^{20}m^{-3}$. As discussed hereinafter, the maximum plasma density in the x-ray device of the present invention will not exceed $n_i<5\times10^{19}m^{-3}$, so that microwave tubes with frequencies <60 GHz will suffice for operation.

Gyrotron tubes which generate >200 kw over the specified microwave frequency range are available from the Microwave Power Tube Division of Varian Associates in Palo Alto, Calif. As a result of Department of Energy (DOE) investments in high-power microwave tubes, sources operable at frequencies of 28, 56, 90, and 140 GHz with nominal output powers of 200 kw are commercially available. Additionally, the magnitudes of magnetic fields that cause electron gyration about a field line to resonant with a microwave frequency from 9 to 90 GHz is 0.32 to 3.2 T (3.2 to 32 kgauss), respectively. The magnetic field for electron cyclotron resonance at 56 GHz is ≅2.0 T. As magnitudes of the resonant magnetic fields required are relatively modest, and the coil geometry is a simple solenoid, suitable electromagnetic coils are readily obtainable from commercial fabricators.

Figure 8:
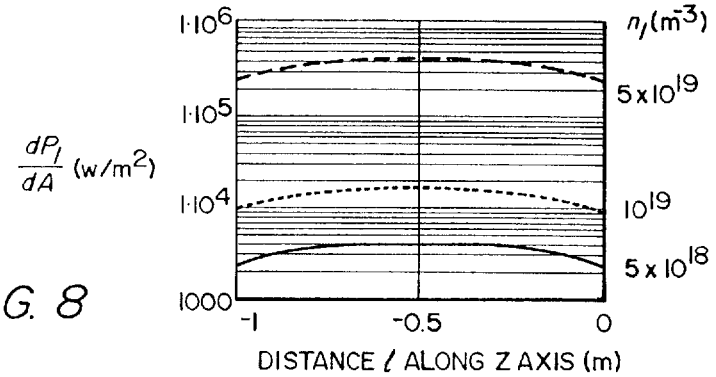
FIG. 8 is a plot of the incident bremsstrahlung power per unit area (w/m$^2$) striking an imaginary surface area as a function of the position along the axis l for plasma densities $n_i=5\times10^{18}$, $10^{19}$, and $5\times10^{19}\text{m}^{-3}$ with $n_{er}=0.1n_i$.

The bremsstrahlung radiated power is dependent on the annular plasma density. The results of integrating Equation 11 for three values of background plasma densities, $n_i=5\times10^{18}$, $10^{19}$, and $5\times10^{19}m^{-3}$ with all other plasma parameters and dimensions remaining the same as the previous calculation, is plotted in FIG. 8. Here, the calculated peak values of radiant flux at the mid point of the axis are 4, 16, and 400 $kw/m^2$ for background plasma densities $n_i$ of $5\times10^{18}$, $10^{19}$, and $5\times10^{19}m^{-3}$, respectively. The values of peak radiant flux, given above, correspond to dose rates of about 1.16, 4.54, and 116 kRad/s under the assumption that the mass energy adsorption coefficient of food products is equivalent to the mass energy adsorption coefficient of water. Thus, increasing the annulus plasma density significantly alters the radiated bremsstrahlung power output from the x-ray device of the present invention over a wide range.

Figure 9:
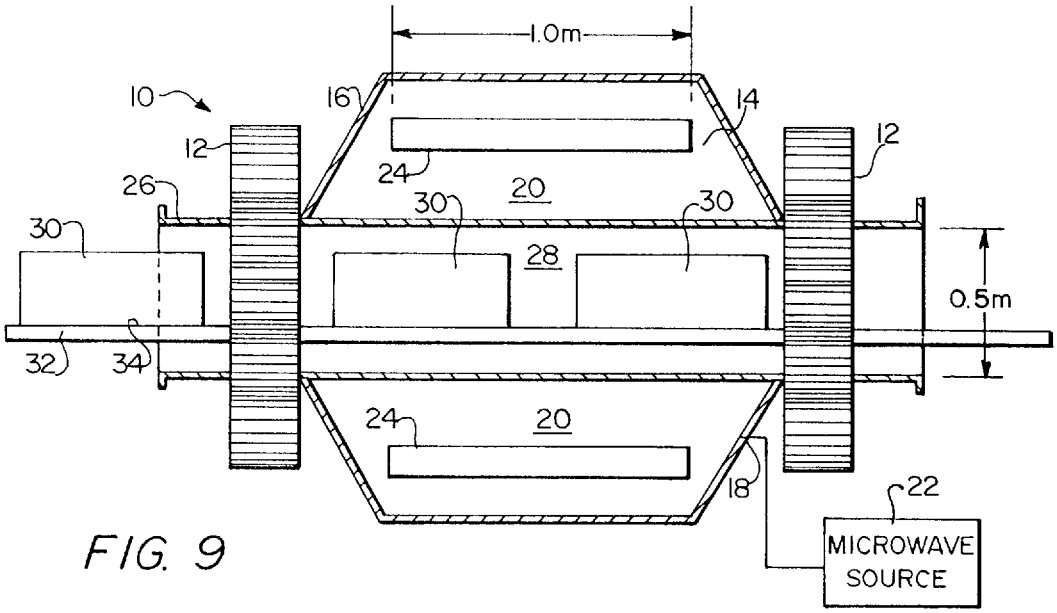
FIG. 9 is a schematic representation of the x-ray device of the present invention, in partial cross-section.

FIG. 9 is a schematic representation of the x-ray device of the present invention. The device 10 of the present invention includes two electromagnetic coils 12 that, when energized, provide the magnetic mirror field required to confine the plasma, as discussed above. The electromagnetic coils 12, preferably, are capable of producing a magnetic field having a magnitude in the range of 0.32 to 3.2 T (3.2 to 32 kgauss). Device 10 includes a vacuum chamber 14 suitable for confining a gas 20. Preferably, the gas utilized in the present invention is one of the noble gases such as xenon (Xe), helium (He), neon (Ne) or argon (Ar).

The chamber wall 16 is formed of a material that will pass x-rays, and may be made of steel, for example. Wall 16 is provided with a terminal 18 for microwave heating of the gas 20. The terminal 18 is connected to a microwave source 22. Microwave source 22 will preferably be capable of operating at frequencies in the range of 9 GHz to 90 GHz with a nominal output power of about 200 kw. As discussed above, the microwave frequency is chosen to be resonant with the second harmonic of the electron cyclotron frequency of particular regions of the mirror field. Heating of the gas 20 in this manner gives rise to the annular plasma structure shown as 24 in FIG. 9, as confined by the mirror magnetic field. In the present invention, the background plasma density $n_i$ in chamber 14 is preferably in the range of $10^{18}$ to $10^{20}$ electrons/$m^3$, with the annular plasma density $n_e=0.1n_i$. The electron temperature Te in the annular plasma is preferably about 2 MeV. The chamber 14 formed by wall 16 preferably has an inner diameter ID of at least about 20 cm, an outer diameter OD of at least about 40 cm, and a length L of at least about 60 cm.

Chamber wall 16 includes a central cylinder 26 with interior opening 28 that is open on both ends to the surrounding air. The device 10 of the present invention includes a support 32 for supporting and locating the product 30 proximate to the chamber 14 for receiving x-rays radiating therefrom. Support 32 may be stationary, or preferably mobile, as shown in the embodiment of FIG. 9, in which support 32 includes a conveyor 34 for moving the product 30 through opening 28 in cylinder 26. This annular geometry shown in FIG. 9 is particularly well suited to irradiating food products moving through cylinder 26, as these products will be completely encircled by the radiating media. While the present invention is particularly effective in irradiating food products, it is applicable to any product where irradiation is desired.

Figure 10:
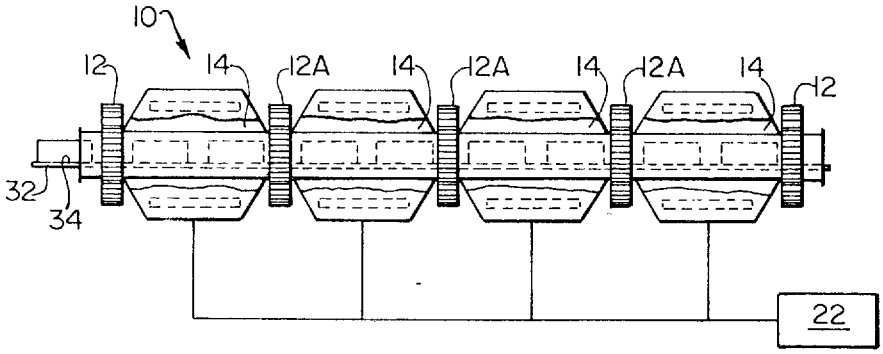
FIG. 10 is a schematic representation of an embodiment of the present invention with a plurality of x-ray devices arranged coaxially in series.

FIG. 10 illustrates an embodiment of the present invention in which a plurality of chambers 14 are arranged coaxially in series and each is connected to a microwave source 22. In certain applications, a plurality of microwave sources may be used. The arrangement of FIG. 10 increases the throughput capacity of the device. Further, this arrangement permits certain electromagnetic coils 12A to be shared between chambers 14. This reduces the number of coils required for n chambers from 2n to n+1, which results in capital savings. Radiation from chambers 14 is directed not only radially inward toward central opening 28 but also radially outward. In the embodiments of FIGS. 9 and 10, this outward radiation can be taken advantage of by circulating the products 30 on a conveyor system, for example, that makes several passes within a shielded room housing the x-ray devices 10. In this manner, the products 30, e.g. food products, receive a large x-ray dose prior to entering the central opening 28 in the device(s) and thereby reduces the time required in central region 28 for adequate exposure.

Figure 11:
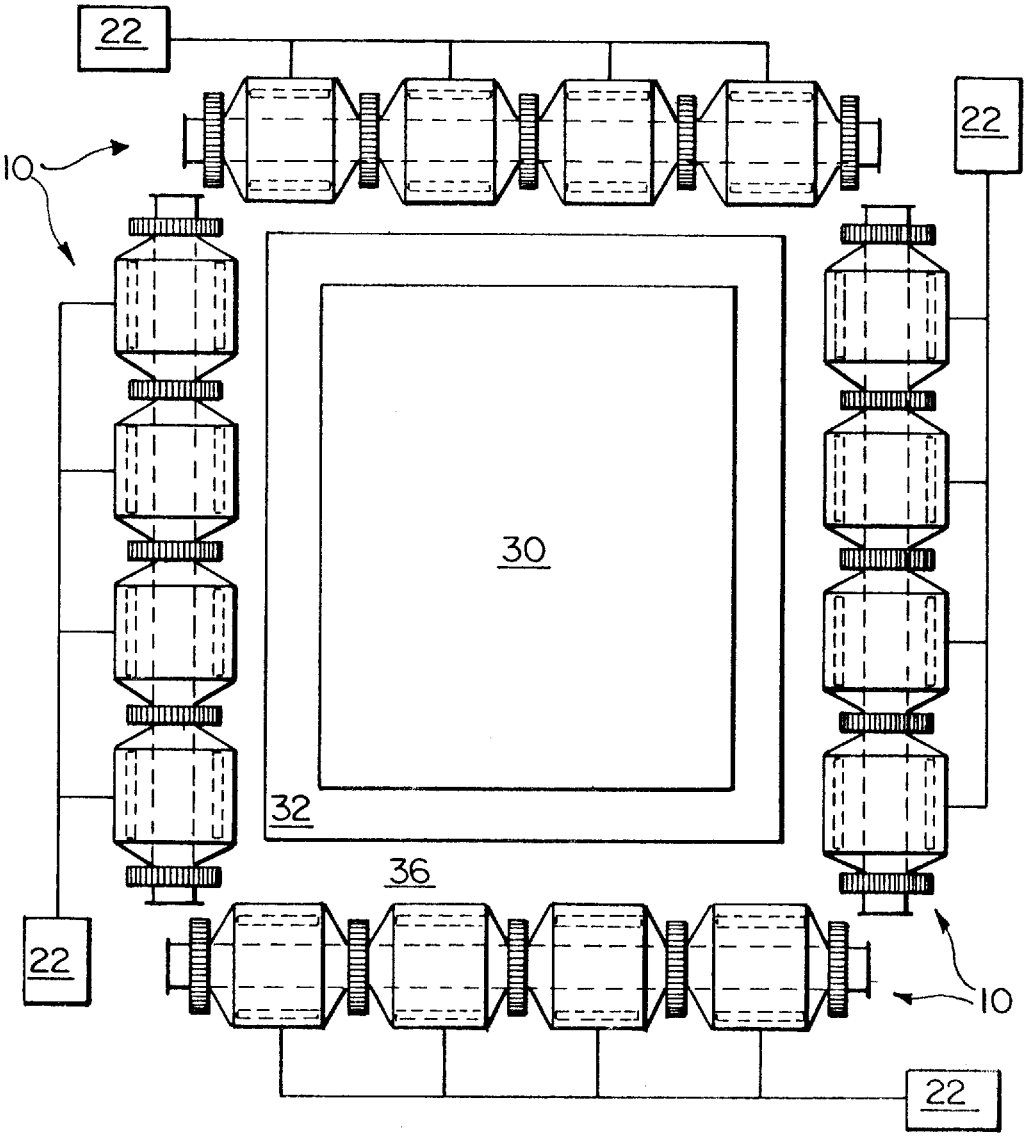
FIG. 11 is a schematic representation of an embodiment of the present invention with a plurality of x-ray devices arranged in an array.

Another embodiment of the present invention, shown in FIG. 11, takes further advantage of such outward radiation and eliminates the need for a central channel with a support or conveyor located therein. In such embodiment, the devices 10 are arranged in an array which could take any suitable form such as a rectangle or square (as shown). Such array surrounds central open area 36. Located within open area 36 is support 32 for locating the product(s) 30 proximately to x-ray devices 10 of the present invention. Support 32 may be stationary and may simply comprise a floor area, or may be movable, such as an elevator that lifts/lowers a pallet of food products 30 into/out of central open area 36.

Figure 12:
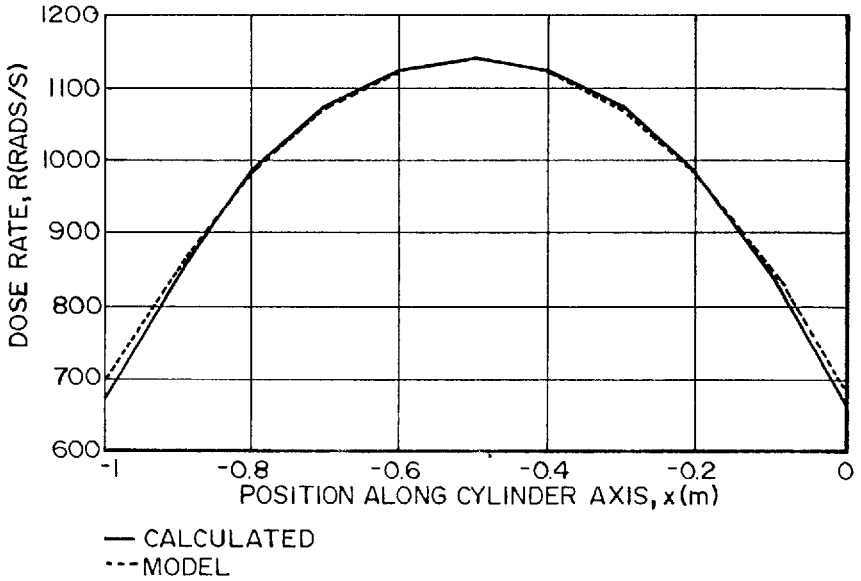
FIG. 12 is a plot of the calculated values of dose rate using Equation 11 and dose rate values calculated using an analytical model, Equation 17, plotted as functions of position along the axis of a cylinder at a radius of 0.2 m.

With reference again to FIG. 9 and assuming the platform 32 includes a conveyor 34, the previous calculations can be used to calculate the total dose D received by a cylindrical object passing through x-ray device 10 with a plasma annulus 24 of length L at a constant velocity V. Converting the results of the calculations plotted in FIG. 6 to Rads/s, the dose rate R(z) is modeled as a parabolic function of the distance x along the axis as Equation 17:

$$R(z)=-1{,}799(z-0.5)^2+1{,}139,$$

and this equation is plotted as a function of axial position in FIG. 12. For comparison, the curve appearing in FIG. 6 (after conversion to Rads/s) is also replotted in FIG. 12. The parabolic fit is very good as is seen in the graph. The analytical model is a convenient means of calculating the total dose D received by a cylindrical object transiting a plasma annulus 24 of length L at a constant velocity v. Assuming that only radiation directly entering the cylindrical surface is absorbed, i.e., neglecting the radiation incident on the circular ends and that penetrating through the product, e.g. food, the dose absorbed at an axial position z and radius r is given by the product of the rate of absorbed dose R(z) multiplied by the time dt spent at the position r,z. Since a point on the surface is moving at a constant velocity v, the time dt=dz/v, and by symmetry, $dD(z)=2\pi r\,R(z)dz/v$ is the dose absorbed through the elemental surface $d\sigma=2\pi r\,dz$. The total dose D in Rads absorbed by the cylindrical object is calculated by integrating Equation 17 along the z axis, i.e., Equation 18:

$$D=\int_0^L \frac{2\pi r}{v}\,R(z)dz=\int_0^L \frac{2\pi r}{v}\,[-1{,}799(z-0.5)^2+1{,}139]dz$$

Figure 13:
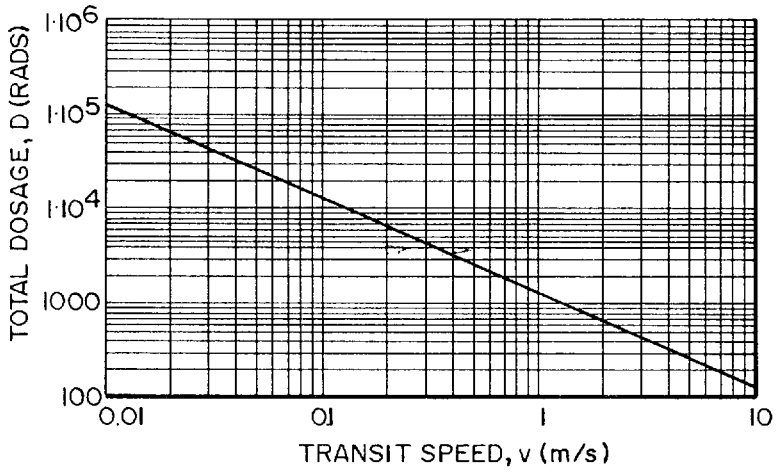
FIG. 13 is a plot of the total dose received by a product as a function of velocity through an x-ray device of the present invention with length L=lm and surface radius a=0.2 m.

Using the device parameters from earlier calculations, i.e., L=1 m, and the radius of the imaginary surface a=0.2 m, the total dose received D is plotted as a function of velocity $v_i$ in FIG. 13. The products will receive a total dose better than 10 to 60 kRads (100 to 600 Gy) moving through x-ray device 10 at a speed of 0.1 to 0.02 m/s, (corresponding to a transit time of 10 to 50 s) respectively. This calculation does not include bremsstrahlung generated by the impact of energetic electrons on the walls 16 of device 10, so that this is a minimum dosage calculation. Additionally, dose rates absorbed by the product, e.g. food, are controlled by the amount of microwave power put into device 10 and the transsit time of the product through device 10. Thus, dosage may be lowered by lowering the microwave power input, or passing the products 30 through device 10 at higher speeds.

The radiated power from x-ray device 10 of the present invention is consistent with achieving a high throughput of irradiated food products when compared to x-ray dosages required to perform food preservation treatments.

The annular geometry of the x-ray device of the present invention (FIGS. 9 and 10) is highly amenable to irradiating products moving through the device, especially food products, as these products will be completely encircled by the radiating media. Operating a plurality of devices in series (FIG. 10) increases product throughput and results in certain capital savings. Arrangement of the x-ray devices in an array (FIG. 11) permits irradiation of large products.

The calculated estimates of radiant flux of the present invention are conservative and do not take into account several factors that enhance x-ray intensity. These factors include the thick target bremsstrahlung from the side walls and the bremsstrahlung collisions with unionized gas atoms and electrons. Inclusion of these factors may increase the dose rates an order of magnitude over the calculated values, and accordingly, reduce the required exposure time by the same factor.

While the present invention has been described in terms of preferred embodiments, various changes and modifications will become apparent to those having skill in the pertinent art. All such modifications and enhancements are intended to fall within the scope and spirit of the present invention, limited only by the following claims.

I claim:

1. An x-ray apparatus for product irradiation comprising:

a chamber and a gas confined within said chamber;

means connected to said chamber for heating said gas to create a hot electron plasma;

means disposed proximate to said chamber for magnetically confining said hot electron plasma in an annular configuration;

and means for supporting and locating said product proximately to said chamber for receiving x-rays radiating therefrom; and wherein said chamber has an inner diameter of at least about 20 cm, an outer diameter of at least about 40 cm and a length of at least about 60 cm.

2. An apparatus as in claim 1 wherein said chamber encompasses an interior opening and said support means is located at least partially within said opening.

3. An apparatus as in claim 2 wherein said support means includes a conveyor passing through said opening.

4. An apparatus as in claim 1 including a plurality of said chambers and including a means for magnetically confining said plasma associated with each said chamber and wherein said means for heating is connected to each of said plurality of chambers.

5. An apparatus as in claim 4 wherein at least two of said chambers share a portion of one of said means for magnetically confining.

6. An apparatus as in claim 4 wherein said plurality of chambers are arranged coaxially in series.

7. An apparatus as in claim 6 wherein each of said chambers encompasses an interior opening.

8. An apparatus as in claim 7 wherein said support means includes a conveyor passing through said interior opening.

9. An apparatus as in claim 4 wherein said plurality of chambers are arranged in an array surrounding a central open area.

10. An apparatus as in claim 9 wherein said support means is located within said central opening.

11. An apparatus as in claim 1 wherein said means for magnetically confining said plasma includes two electomagnets forming a magnetic mirror with a magnetic mirror field; and wherein said means for heating said gas includes a microwave power source including means for generating a microwave frequency that is resonant with a second harmonic of an electron cyclotron frequency of particular regions of said magnetic mirror field.

12. An apparatus as in claim 1 wherein said means for heating said gas includes a microwave power source.

13. An apparatus as in claim 12 wherein said microwave power source includes means for generating microwave frequencies in the range of 9 GHz to 90 GHz.

14. An apparatus as in claim 1 wherein said means for magnetically confining said plasma includes two electromagnets forming a magnetic mirror with a magnetic mirror field.

15. An apparatus as in claim 14 wherein said magnetic mirror has a mirror ratio of 2.

16. An apparatus as in claim 14 wherein said magnetic field has a magnitude in the range of 3.2 to 32 kgauss.

17. An apparatus as in claim 1 wherein said plasma is heated to a temperature of about 2 MeV.

18. An apparatus as in claim 1 wherein said gas is a noble gas.

19. An apparatus as in claim 1 wherein said gas is a gas from a group including xenon, helium, neon and argon.

20. An apparatus as in claim 1 wherein said plasma has a density in the range of $10^{18}$ to $10^{20}$ electrons/$m^3$.

21. A method for product irradiation comprising:

confining a gas within a chamber;

heating said gas to create a hot electron plasma;

magnetically confining said hot electron plasma in an annular configuration;

supporting and locating said product proximately to said chamber for receiving x-rays radiated therefrom: and wherein said magnetically confining step includes forming a magnetic mirror and a magnetic mirror field using two electromagnets; and wherein said heating step includes using a microwave power source having a frequency that is resonant with a second harmonic of an electron cyclotron frequency of particular regions of said magnetic mirror field.

22. An apparatus as in claim 21 including the step of arranging a plurality of said chambers in an array surrounding a central open area and said supporting and locating step includes locating said product in said central open area.

23. A method as in claim 21 including the step of forming an interior opening within said chamber.

24. An apparatus as in claim 23 wherein said step of supporting and locating includes the step of conveying said product through said interior opening.

25. An apparatus as in claim 23 including the step of arranging a plurality of said chambers coaxially in series.

26. An apparatus as in claim 25 including the step of forming an interior opening within each of said chambers.

27. An apparatus as in claim 26 wherein said step of supporting and locating includes the step of conveying said product through each chamber interior opening.

* * * * *